US005301482A

United States Patent [19]

Aspenwall

[11] Patent Number: 5,301,482

[45] Date of Patent: Apr. 12, 1994

[54] ADJUSTABLE TRUSS ASSEMBLY FOR SUPPORTING SHOWCASES AND THE LIKE

[75] Inventor: John E. Aspenwall, Lehi, Utah

[73] Assignee: Jahabow Industries, Inc., Owensville, Mo.

[21] Appl. No.: 78,360

[22] Filed: Jun. 21, 1993

[51] Int. Cl.[5] ..... E04C 3/10

[52] U.S. Cl. ..... 52/223.1; 52/223.8; 52/223.14; 312/140

[58] Field of Search ..... 52/223.1, 223.8, 223.11, 52/223.12, 223.13, 223.14; 312/140, 265.1

[56] References Cited

U.S. PATENT DOCUMENTS

| | | | |
|---|---|---|---|
| 1,243,000 | 10/1917 | Stewart | 52/223.8 |
| 2,675,695 | 4/1954 | Coff | 52/223.8 |
| 3,810,337 | 5/1974 | Pollard | 52/223.8 |
| 3,971,179 | 7/1976 | Bodocsi et al. | 52/223.11 |
| 4,632,473 | 12/1986 | Smith | 312/265.1 |

FOREIGN PATENT DOCUMENTS

| | | | |
|---|---|---|---|
| 2319842 | 1/1977 | France | 312/140 |
| 452126 | of 1936 | United Kingdom | 52/223.1 |

*Primary Examiner*—Carl D. Friedman
*Assistant Examiner*—Kevin D. Wilkens
*Attorney, Agent, or Firm*—M. Reid Russell

[57] ABSTRACT

A truss assembly for supporting showcases and the like includes a straight open box tube with end caps arranged for fitting over to close the box tube ends. A tension rod is fitted through the box tube and passes beneath a fulcrum arranged across the middle of the box tube, proximate to the inner surface of the box tube bottom, with the tension rod ends threaded and passed through holes that are formed through the end caps to receive a nut turned thereover. The nuts are turned against the end cap outer surfaces so as to create a tensile stress in the tension rod that is exerted through the fulcrum, tending to lift the fulcrum and box tube middle section, bowing the box tube upwardly counter a weight of a showcase containing items supported thereon, whereby the box tube is bent back to essentially a horizontal attitude. The truss assembly of the invention further provides for mounting the box tube ends to vertical support members so as to extend therebetween, maintaining a showcase thereon.

5 Claims, 2 Drawing Sheets

ADJUSTABLE TRUSS ASSEMBLY FOR SUPPORTING SHOWCASES AND THE LIKE

BACKGROUND OF THE INVENTION

1. Field of the Invention

This invention relates to pre-stressed supports for maintaining an item between end piers and in particular to horizontal beams for supporting display cases or showcases, and the like, maintained thereon.

2. Prior Art

Retail store display cases or showcases having glass covered or open faces that are supported on a wall surface, maintained on braces or supports, or arranged between piers and the like, for containing items for sale have long been known and are in common use. With arrangements where a display case or showcase is supported on a horizontal support member, such as a plate, channel, tubing, or the like, supported between upright piers, it is often the case that the weight of the display case or showcase will tend to bend that horizontal support downwardly, detracting from the appearance of the case and the products maintained therein. The present invention solves this problem by providing a pre-stressed beam arrangement that is bowed upwardly to counter the weight of a loaded display case or showcase where the beam is essentially horizontal.

BRIEF SUMMARY OF THE INVENTION

It is a principal object of the present invention in an adjustable truss assembly for supporting display cases or showcases, and the like, to provide a pre-stressed truss assembly for mounting, at its ends, between vertical supports to horizontally support a display case or showcase maintained thereon.

Another object of the present invention is to provide a truss assembly that includes a box tube for mounting at its ends to each of a pair of vertical supports, to extend horizontally therebetween and including, a tension rod that extends between box tube end caps and is passed under a fulcrum that is secured across the box tube mid-section and placed under tension to provide a lifting force at the fulcrum to counter a weight of a display or showcase supported on the box tube.

Another object of the present invention is to provide, as a fulcrum, a rod that is secured across approximately the box tube middle and is centrally slotted therearound to accommodate the rod fitted therein.

Still another object of the present invention is to provide with the box tube end caps, holes formed therethrough to accommodate a threaded end of the tension rod that is fitted therethrough that receives a nut turned thereover and against the surface of the box tube end cap for applying a tensile stress to the rod, and a bolt turned therein for mounting the box tube end to a vertical support.

Still another object of the present invention is to provide a truss assembly for supporting a display case or showcase that is pre-stressed to resist bending with the weight of a filled display case or show case resting thereon, that is easy to assemble and install and provides a visually attractive support arrangement that does not detract from the appearance of the display case or showcase and its contents.

In accordance with the above objects, the adjustable truss assembly for supporting showcases and the like of the invention includes a truss beam that is preferably a square box tube, and includes end caps for fitting in to close off each box tube end. The end caps each include a pair of spaced apart vertically aligned holes formed therethrough. A lower hole of each end cap is preferably threaded for receiving a bolt turned therein that has been passed through an end stop plate secured to a vertical support member, mounting the box tube end to the vertical support member at approximately a right angle. The upper hole of each end cap is to receive a threaded end of a tension rod fitted therethrough that, in turn, receives a nut turned thereon to engage the end cap surface. The two nuts each turned onto each of the tension rod ends, against the end cap surfaces, provide for an application of a tensile force or stress to the tension rod.

To direct the tensile stress in the tension rod, in opposition to the weight of a display case or showcase supported on the box tube, the box tube is fitted with a fulcrum mounted therein, across its center, whereunder the tension rod passes. The tensile stress is thereby directed through the fulcrum, and tends to lift that fulcrum so as to create a convex bend at the box tube center to lift a display case or showcase and items therein. The fulcrum is preferably a section of a rod that is maintained across the box tube front and rear sides, proximate to the tube lower surface, by fitting a lesser diameter threaded shaft end thereof through a first larger diameter hole formed in the box tube front side, just above the lower surface, and through an aligned lesser diameter hole that is formed through the box tube rear side. The rod section threaded shaft is to receive a nut fitted thereover and turned against the outer face of the box tube rear side, securing the rod section across the box tube, just above the lower interior surface thereof. The rod section preferably includes a center groove formed therearound for receiving the tension rod.

In practice, the nuts fitted onto the tension rod threaded ends are turned against the end cap surfaces, applying a certain tensile stress to the tension rod that is sufficient to bow the box tube upwardly to just overcome the weight of the display case or showcase and its contents supported thereon. The box tube is thereby bent opposite to the stress exerted by the tension rod into a straight horizontal attitude supporting the, display case or showcase and the items contained therein. The display case or showcase can include a skirt arrangement for covering the box tube or the box tube can be formed of a material that is appropriate for display.

Other objects and features of the invention will become apparent from the following detailed description in conjunction with the drawings disclosing what is presently contemplated a being the best mode of the invention.

DESCRIPTION OF THE DRAWINGS

In the drawings that illustrate that which is presently regarded as the best mode for carrying out the invention.

DETAILED DESCRIPTION

Figures 1, 2:
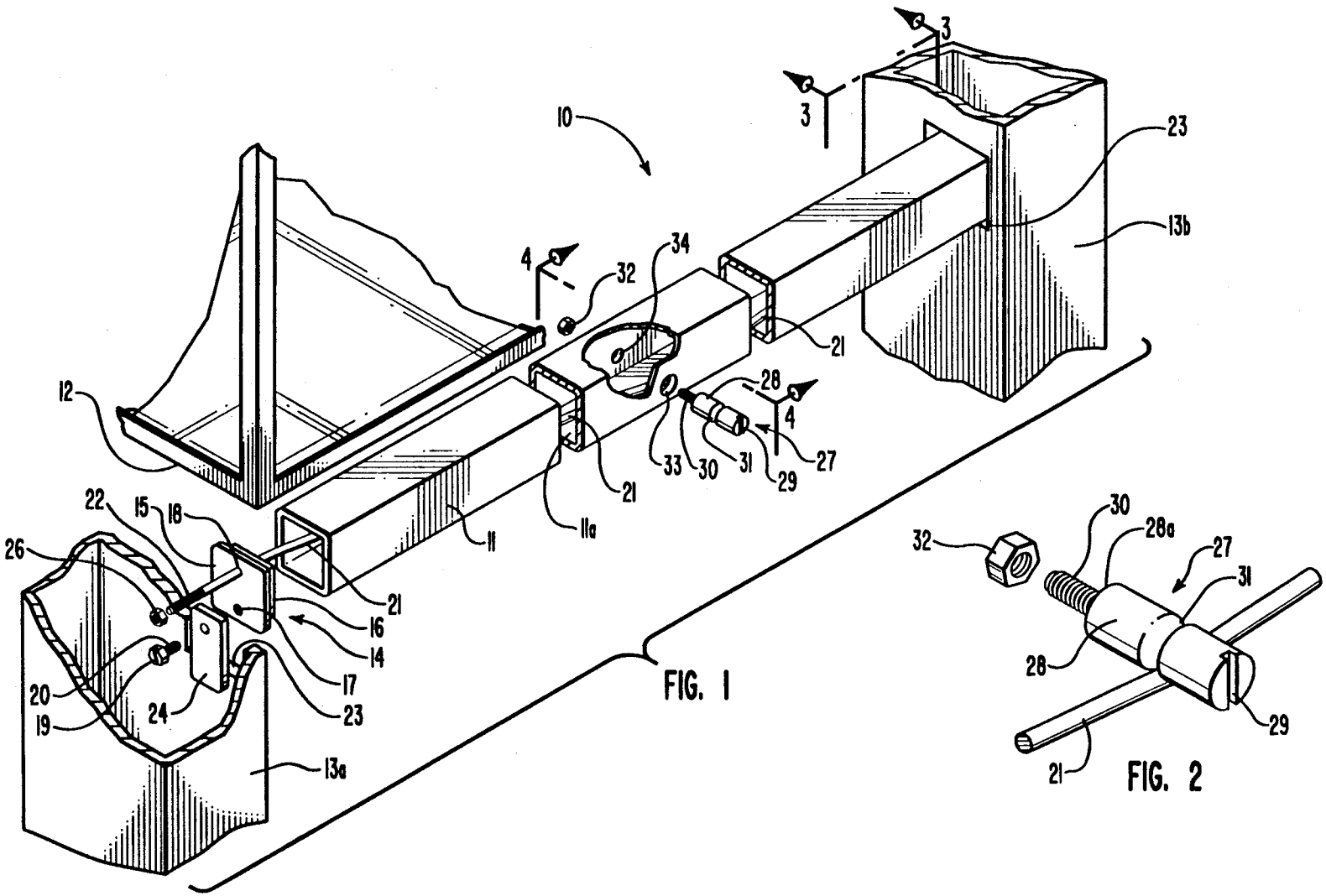
FIG. 1 is a profile perspective exploded view of an adjustable truss assembly for supporting showcases and the like of the invention taken from a left side when facing a showcase maintained thereon, shown as a section of a showcase, showing a left end thereof exploded off from a vertical support and showing a center section of a box tube broken away to receive a fulcrum fitted thereacross.
FIG. 2 is a profile perspective view of the fulcrum of FIG. 1 removed from the box tube and showing a nut exploded off of a fulcrum threaded axial shaft.

An adjustable truss assembly for supporting showcases and the like 10 of the invention is shown in FIG. 1, and is hereinafter referred to as a truss assembly. Truss assembly 10, as shown best in FIG. 1, includes a square or box tube Il that is preferably formed from a rigid material, such as steel, and can be coated or plated with a reflective material, such as chrome, or the like, to have an attractive appearance that is suitable for use in a retail store setting, or the like. The box tube 11 has a sufficient wall thickness to support the weight of a showcase 12 or showcases, shown as a corner section in FIG. 1, supported thereon that displays a number of items. The box tube 11 is, preferably, somewhat flexible to allow for some binding thereof, as set out hereinbelow.

The box tube 11, as shown, is supported between left and right vertical supports 13*a* and 13*b*, respectively, that are shown as hollow tubes and are preferably formed of a metal material to support the weight of the truss assembly 10 and display case or showcase 12 and are coated to provide a pleasing appearance suitable for display in a retail store. Though the vertical supports 13*a* and 13*b*, it should be understood, can be any suitable vertical support structures, including, but not limited to, other display cases or showcases, cantilevered wall supports, pillars, posts, and the like and can be formed of any suitable material or materials.

Figure 3:
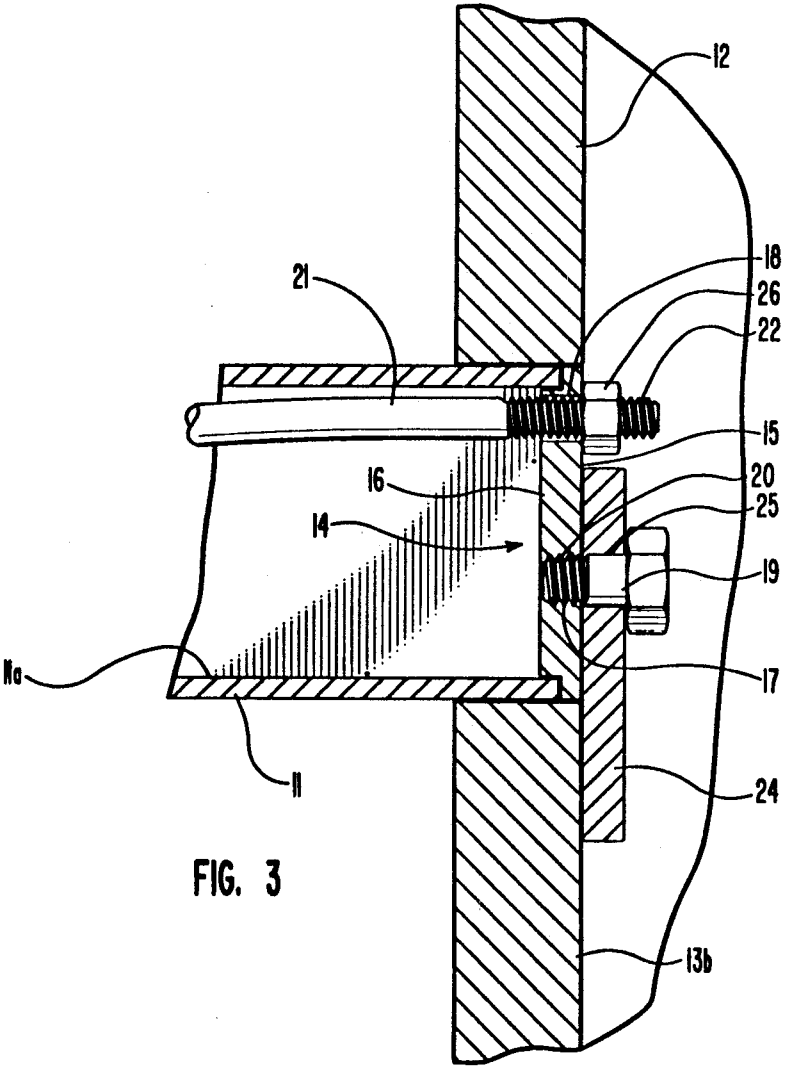
FIG. 3 is an enlarged sectional view taken along the line 3—3 of FIG. 1 showing the box tube mounted to the vertical support and showing a nut turned onto a threaded end of a tension rod.

The box tube 11 open ends are each closed by a square flat plate end cap 14, each end cap stepped inwardly from around an outer edge of a flat section 15 that has a cross section of the box tube outer surface to a smaller flat section 16 that is to fit snugly into the box tube end. The end caps 14 each include a pair of vertically spaced and aligned lower and upper holes 17 and 18, respectively. The lower hole 17, as shown best in FIG. 3, is threaded to receive a bolt 19 threaded end 20 turned therein, as set out below. The upper hole 18 is smooth walled to receive a threaded end 22 of a tension rod 21 fitted therethrough, as set out below. The end caps 14 smaller flat sections 16 are to fit into the box tube ends so as to provide a metal to metal contact between the box tube end edges and the surface of the end cap flat section 15 adjacent to its edge.

As shown in FIGS. 1 and 3, the left and right vertical supports 13*a* and 13*b*, respectively, each include square holes 23 formed therein that face one another and are each for receiving a box tube end fitted therein, as shown best in FIG. 3. The vertical supports 13*a* and 13*b* each include end stop plates 24 that are each secured, as by welding, brazing, or the like, across lower portions thereof to inner surfaces of the respective vertical supports adjacent to lower edge of a square hole 23. Each end stop plate 24 is to be contacted by an end of the box tube fitted into a square hole 23 and includes a smooth hole 25 formed therethrough that is for aligning with the end cap 14 lower threaded hole 17. For maintaining the box tube ends within the vertical supports square holes 23 the threaded ends 20 of bolts 19 are each passed through an end stop plate smooth hole 25 and turned into an end cap lower threaded hole 17. So arranged, the box tube end surface rests upon the edge of the square hole 23 that has been formed in the vertical support 13*a* or 13*b*. To provide for the turning of the bolts 19 through each end stop plate smooth hole 25 and into the end cap lower threaded hole 17 the vertical support may be open across a top end so as to allow a tool, such as a wrench to be fitted therein, or a hole may be formed in a side of the vertical support away from exposure to patrons of a retail store that the invention is utilized in, or a like arrangement may be employed within the scope of this disclosure.

The tension rod 21 as set out above, is preferably a continuous rod that has a length such that it will extend through the box tube 11 with the threaded ends 22 passing through the end cap 14 upper hole 18, as shown in FIGS. 1 and 3, and receive a nut 26 turned thereover. In which passage through the box tube 11 the tension rod 21 is fitted under a fulcrum 27, shown in FIGS. 1, 2 and 4, that is maintained across and within the box tube, just off the inner surface 11*a* of the box tube bottom side. The fulcrum 27 is preferably a straight cylinder 28 that has been slotted at 29 across one end, for receiving a screw driver type tool, not shown, fitted therein for turning the cylinder. A portion of the cylinder that is fitted across the box tube is smooth and is stepped inwardly at a right angle wall 28*a* into a threaded shaft 30 that extends axially from the cylinder end opposite to slot 29. A center groove 31 is preferably formed around a mid-section of the cylinder 28, wherein the tension rod 21 is seated, and a nut 32, as shown best in FIG. 2, is positioned for turning over the end of the threaded shaft 30.

Figure 4:
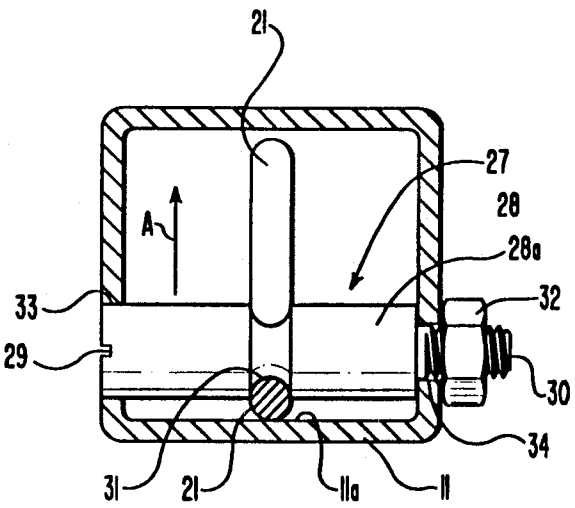
FIG. 4 is a cross sectional view taken along the line 4—4 of FIG. 1, showing the fulcrum as a rod section that is fitted across the box tube with the tension rod maintained in a center groove of the fulcrum.

As shown best in FIG. 4, for fitting the fulcrum 27 across the box tube 11, just above the inner surface 11*a* thereof the cylinder threaded shaft 30 end is first fitted through a hole 33 formed through a front side wall of the box tube 11 that has a diameter to accommodate the straight cylinder 28 fitted therein. The threaded shaft 30 is then fitted through a second aligned lesser diameter hole 34 that is formed through the opposite box tube side wall. With the threaded shaft 30 fitted through the hole 34, the nut 32 can be turned thereover against the outer surface of the box tube side pulling the cylinder stepped wall 28*a* against the inner surface of the box tube around the hole 34. The fulcrum 27 is thereby securely mounted across the box tube with the cylinder groove 31 approximately centered across the box tube interior.

In practice, the truss assembly 10 is assembled by fitting the tension rod 21 through the box tube 11, passing it beneath the fulcrum cylinder 28 that has been installed across the box tube interior, the tension rod sliding along the cylinder groove 31, above the inner surface 11*a* of the box tube bottom side. The tension rod 21 is preferably formed from a metal material, such as steel, that is essentially inelastic so as not to stretch when subject to a tensile stress. With the tension rod 21 fitted through the box tube 11, the rod threaded ends 22 are fitted through the upper holes 18 of the box tube end caps 14. With the end caps fitted into the box tube ends, as shown best in FIG. 3, the nuts 26 are turned onto the tension rod threaded ends 22 and against the surface of the end cap flat section 15. The nuts 26 can be tightened against the end cap surface prior to mounting the box tube between vertical supports 13*a* and 13*b* to produce a tensile stress in the tension rod 21 that is directed against the fulcrum 27 undersurface. This force tends to lift that fulcrum, bending the box tube upwardly. The tensile stress in the tension rod is directed in to lift the fulcrum, bowing the box tube upwardly so as to over come the downward force that is directed on the box tube by the weight of display case or showcase 12 and contained items as would tend to bend the box tube downwardly, the forces to balance such that the box tube remains essentially horizontal. Alternatively, the nuts 26 can be turned into a snug fit against the surface of the end cap flat section 15 and then further turned to apply a tensile stress in the tension rod 21 to counter the weight of a display case or showcase 12 and the items contained therein so as to lift the box tube back to a horizontal attitude.

With the tension rod 21 mounted in the box tube 11, as set out above, the assembly can be fitted through the square holes 23 in the left and right vertical supports 13*a* and 13*b*, respectively, to where the holes 25 through the end stop plates 24 align with the lower threaded hole 17 in each end cap 14. The threaded shaft end 20 of each bolt 19 is then fitted through the end stop plate hole 25 and turned into the end cap lower threaded hole 17, as shown in FIG. 3, completing the mounting of the box tube 11 to the vertical supports. Which fitting and turning of the bolt 19 threaded ends 20 is performed through open tops of the vertical supports, not shown, or through holes formed into the sides of the vertical supports out of sight of retail store shoppers, not shown, or through other appropriate openings, not shown. Such access openings are to provide access to an operator fitting a tool or tools, not shown, therein for turning the bolt 19, and, as required, the nut 26 to apply or release a tensile stress in the tension rod 21 to accommodate the weight of display case or showcase 12 and its contents supported therein, as shown in FIG. 1.

Although a preferred form of my invention in a truss assembly for supporting showcases and the like has been shown and described herein, it should be understood that the present disclosure is made by way of example only and that variations are possible without departing from the subject matter coming within the scope of the following claims and a reasonable equivalency thereof, which subject matter I regard as my invention.

I claim:

1. A truss assembly for supporting showcases or the like comprising, a longitudinally open straight tube of a length to be supported between support means; support means that include means for coupling to ends of said tube to maintain said tube in essentially a horizontal attitude between said support means for supporting a showcase thereon; a fulcrum means mounted within and across a mid-section of said tube, positioned above a bottom interior surface; that consists of a straight cylinder having a tool receiving recess formed across one end and is stepped inwardly into a straight rod section adjacent to the other cylinder end that is threaded into an axial threaded shaft, and a first hole formed through a forward tube wall for mounting said cylinder across the interior of said tube to accommodate said smooth straight cylinder fitted therethrough, and a second hole aligned with said first hole formed through a rear rube wall to accommodate said axial threaded shaft, and a nut means for turning onto said axial threaded shaft; a tension rod for fitting through said tube, passing between said fulcrum means and said tube bottom interior surface, said tension rod having opposite ends that are each threaded and extend from said tube open ends; end cap means for arrangement across said tube open ends, where each said end cap includes a tension rod hole formed therethrough to pass one of said tension rod threaded ends therethrough; and means for turning onto each of said tension rod threaded ends and into engagement with said end cap for applying a tensile stress into said tension rod.

2. A truss assembly as recited in claim 1, wherein the tube is a straight square or box tube formed of a metal such as steel and an end surface of each of said end cap fits across said box tube end and said end cap is stepped inwardly from one parallel face to another from the outside dimensions of a cross section of said box tube to the inside dimension of a cross section of said box tube to seat therein, and, when the ends caps are appropriately seated in said box tube ends, the corresponding tension rod holes formed through each said end cap that receive the tension rod threaded ends fitted therethrough are aligned.

3. A truss assembly as recited in claim 2, wherein the support means are a pair of support tube that are supported vertically, with each support tube including a hole formed in a face thereof to accommodate an end of the box tube fitted therein, said support tube holes facing one another supporting said box tube therebetween; end stop plate means mounted within each said support tube so as to extend into said tube and formed to receive and stop further travel of said box tube end fitted therein; and means for securing said box tube end cap to said end stop plate means.

4. A truss assembly as recited in claim 3, wherein the end stop plate means is a flat metal section that is secured across its lower section to an inner surface of the vertical tube, an upper section of said end stop plate means blocking passage of the box tube end cap; and aligned smooth and threaded holes formed, respectively, in said stop plate means and said box tube end cap for receiving a bolt fitted through said smooth hole and turned into said threaded hole in said box tube end cap.

5. A truss assembly as recited in claim 1, further including a slot formed around a mid-section of the straight cylinder; and the tool receiving recess formed in one end of said smooth straight cylinder is a slot for receiving a blade of a screw driver fitted therein.

* * * * *